US012522906B2

(12) United States Patent
Kasai et al.

(10) Patent No.: US 12,522,906 B2
(45) **Date of Patent: *Jan. 13, 2026**

(54) FREE-CUTTING STEEL AND METHOD FOR MANUFACTURING SAME

(71) Applicant: JFE STEEL CORPORATION, Tokyo (JP)

(72) Inventors: Masayuki Kasai, Tokyo (JP); Kazuaki Fukuoka, Tokyo (JP); Kimihiro Nishimura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 427 days.

This patent is subject to a terminal disclaimer.

(21) Appl. No.: 17/906,975

(22) PCT Filed: Mar. 31, 2021

(86) PCT No.: PCT/JP2021/014050
§ 371 (c)(1),
(2) Date: Sep. 22, 2022

(87) PCT Pub. No.: WO2021/201179
PCT Pub. Date: Oct. 7, 2021

(65) Prior Publication Data

US 2023/0193440 A1 Jun. 22, 2023

(30) Foreign Application Priority Data

Mar. 31, 2020 (JP) ..... 2020-063748

(51) Int. Cl.
*C22C 38/60* (2006.01)
*C22C 38/00* (2006.01)
*C22C 38/04* (2006.01)
*C22C 38/18* (2006.01)

(52) U.S. Cl.
CPC ..... *C22C 38/60* (2013.01); *C22C 38/001* (2013.01); *C22C 38/002* (2013.01); *C22C 38/04* (2013.01); *C22C 38/18* (2013.01)

(58) Field of Classification Search
CPC ..... C21D 1/02; C21D 7/13; C21D 8/065; C21D 9/0075; C21D 9/22; C22C 38/001; C22C 38/002; C22C 38/008; C22C 38/02; C22C 38/04; C22C 38/16; C22C 38/18; C22C 38/20; C22C 38/24; C22C 38/28; C22C 38/40; C22C 38/60
See application file for complete search history.

(56) References Cited

U.S. PATENT DOCUMENTS 7,488,396 B2 2/2009 Hashimura et al.
8,124,008 B2 2/2012 Murakami et al.
2003/0152476 A1* 8/2003 Matsui ..... C22C 38/14 420/42
2005/0025658 A1 2/2005 Matsui et al.
2009/0050241 A1* 2/2009 Hashimura ..... C22C 38/002 148/548
2010/0054984 A1 3/2010 Hashimura et al.
2023/0029298 A1* 1/2023 Kasai ..... C21D 8/06
2023/0108640 A1* 4/2023 Kasai ..... C21D 9/0081 420/104
2025/0230530 A1* 7/2025 Tada ..... C22C 38/38

FOREIGN PATENT DOCUMENTS

| | | | |
|---|---|---|---|
| CN | 1580312 | A | 2/2005 |
| CN | 101184859 | A | 5/2008 |
| CN | 101400814 | A | 4/2009 |
| CN | 102952995 | A | 3/2013 |
| CN | 103966531 | A | 8/2014 |
| EP | 1449932 | A1 | 8/2004 |
| EP | 2322680 | A2 | 5/2011 |
| JP | 1026824 | B2 | 2/1990 |
| JP | H0925539 | A | 1/1997 |
| JP | 2000160284 | A | 6/2000 |
| JP | 2002249823 | A | 9/2002 |
| JP | 2003003234 | A | 1/2003 |
| JP | 2004027297 | A | 1/2004 |
| JP | 2004176176 | A | 6/2004 |
| JP | 2004269912 | A | 9/2004 |
| JP | 2005232508 | A | 9/2005 |
| JP | 2007113038 | A | 5/2007 |
| JP | 2009007591 | A | 1/2009 |

(Continued)

OTHER PUBLICATIONS

May 23, 2024, Office Action issued by the Korean Intellectual Property Office in the corresponding Korean Patent Application No. 10-2022-7029658 with English language concise statement of relevance.

Jun. 22, 2021, International Search Report issued in the International Patent Application No. PCT/JP2021/014050.

Jul. 18, 2023, Office Action issued by the China National Intellectual Property Administration in the corresponding Chinese Patent Application No. 202180024292.0 with English language search report.

Jan. 30, 2025, the Extended European Search Report issued by the European Patent Office in the corresponding European Patent Application No. 21779419.7.

*Primary Examiner* — Jie Yang
(74) *Attorney, Agent, or Firm* — KENJA IP LAW PC

(57) ABSTRACT

Free-cutting steel that has the same or better machinability compared to low-carbon sulfur-lead composite free-cutting steel, despite of no-addition of Pb, is provided. Free-cutting steel contains, in mass %, C: 0.08% or less, Mn: 0.50 to 1.50%, P: 0.100% or less, S: 0.250 to 0.500%, N: 0.0050 to 0.0150%, O: more than 0.0100% and 0.0500% or less, Cr: 0.50 to 1.50%, at least one of Si, Al, or Ti: 0.050 to 0.500% in total, with the balance being Fe and inevitable impurities, with an A value defined by formula (1) satisfying 0.40 to 2.00, and with a B value defined by formula (2) satisfying $1.10\times10^{-3}$ to $1.50\times10^{-2}$; and a steel microstructure with distributed 3000 or more sulfide particles with an equivalent circular diameter of 5 μm or less per $mm^2$.

5 Claims, No Drawings

(56) References Cited

FOREIGN PATENT DOCUMENTS

| | | | |
|---|---|---|---|
| KR | 1020100018347 | A | 2/2010 |
| WO | 03046240 | A1 | 6/2003 |
| WO | 2009001667 | A1 | 12/2008 |

* cited by examiner

FREE-CUTTING STEEL AND METHOD FOR MANUFACTURING SAME

TECHNICAL FIELD

This disclosure relates to free-cutting steel, in particular, steel as a substitute for free-cutting steel containing sulfur and a small amount of lead, which are machinability improving elements, and relates to free-cutting steel with the same or better machinability compared to low-carbon sulfur-lead composite free-cutting steel and a method for manufacturing the same.

BACKGROUND

Low-carbon sulfur-lead free-cutting steel, as typified by JIS SUM24L, ensures excellent machinability by adding large amounts of lead (Pb) and sulfur (S) as machinability improving elements.

Among steel materials, lead is useful for reducing tool wear and improving chip handling in cutting work. Therefore, lead is heavily used as an element that greatly improves the machinability of the materials, and is used in a lot of steel products manufactured by cutting work. However, with growing awareness of environmental conservation in recent years, there has been a worldwide movement to abolish or restrict the use of environmentally hazardous substances. Lead is one of such substances whose use is required to be restricted.

For example, JPH09-25539A (PTL 1) describes Pb-free free-cutting non-tempered steel. Similarly, JP2000-160284A (PTL 2) also describes Pb-free free-cutting steel. Furthermore, JPH02-6824B (PTL 3) describes free-cutting steel in which Cr, which is easier to make compounds with S than Mn, is added to allow Mn—Cr—S inclusions to be present, in order to ensure machinability.

CITATION LIST

Patent Literature

PTL 1: JPH09-25539A
PTL 2: JP2000-160284A
PTL 3: JPH02-6824B

SUMMARY

Technical Problem

The technology described in PTL 1 has problems of hardness because a target steel grade is non-tempered steel containing 0.2% or more of C, and high manufacturing cost because of the use of Nd being a special element. The technology described in PTL 2 has low hot ductility due to addition of a large amount of S, and is prone to cracking during continuous casting and hot-rolling, which is problematic from the viewpoint of surface properties. On the other hand, in the technology described in PTL 3, Cr and S are added as components, while the additive amount of Mn is reduced, but the additive amount of Cr is as high as 3.5% or more, which makes it difficult to lower cost, and a large amount of CrS is generated, which causes a manufacturing problem of difficulty in melting a material in a steel manufacture process.

It would be helpful to provide free-cutting steel, together with a method for manufacturing the same, that has the same or better machinability compared to low-carbon sulfur-lead composite free-cutting steel, despite of no-addition of Pb, and that does not require addition of Nd and addition of large amounts of S and Cr, as described in PTL 1 to 3.

Solution to Problem

As a result of diligent research to solve the above problems, the inventors have arrived at the following findings.

(i) It is found out that by adding appropriate amounts of Mn, Cr, and S and optimizing an [Mn]/[Cr] ratio, an appropriate amount of sulfide can have chemical composition in a composite system of Mn—Cr—S. The sulfide with the chemical composition in the composite system can be refined during hot-working, thus improving machinability.

(ii) The finer the above-described sulfide, the greater the lubricating action, which prevents generation of a hard phase, called built-up edge, adhering to a tool surface, and significantly improves machinability, including chip handling and surface roughness.

(iii) It is conventionally known that machinability improves with increase in a S content in steel. On the other hand, there is an upper limit to the amount of S that can be added to the steel due to a problem of hot workability or anisotropy in mechanical properties. Since sulfide of this disclosure is fine, the machinability, including chip handling and surface roughness, is significantly improved. When the sulfide present in the steel is fine, the machinability, including the chip handling and the surface roughness, is significantly improved. Therefore, when the sulfide is finely distributed in the steel, good machinability can be ensured without exceeding the upper limit of the S content, which is specified in term of the hot workability or the anisotropy in the mechanical properties described above.

This disclosure is based on the above findings, and we provide:

1. Free-cutting steel including:
   - a chemical composition containing (consisting of), in mass %,
   - C: 0.08% or less,
   - Mn: 0.50% to 1.50%,
   - P: 0.100% or less,
   - S: 0.250% to 0.500%,
   - N: 0.0050% to 0.0150%,
   - O: more than 0.0100% and 0.0500% or less,
   - Cr: 0.50% to 1.50%, and
   - at least one of Si, Al, or Ti: 0.050% to 0.500% in total, with the balance being Fe and inevitable impurities,
   - with an A value defined by a following formula (1) satisfying 0.40 to 2.00, and
   - with a B value defined by a following formula (2) satisfying $1.10\times10^{-3}$ to $1.50\times10^{-2}$; and
   - a steel microstructure with distributed 3000 or more sulfide particles with an equivalent circular diameter of 5 μm or less per $mm^2$,
   - wherein $$A \text{ value}=[Mn]/[Cr] \quad (1)$$

$$B \text{ value}=(2[Si]+2[Al]+[Ti])\times[O] \quad (2)$$

- where [M] indicates a content in mass % of an element M described in [ ].

2. The free-cutting steel according to the above 1, wherein the chemical composition further contains, in mass %, at least one selected from the group consisting of:
   - Ca: 0.0010% or less;
   - Se: 0.30% or less;
   - Te: 0.15% or less;

Bi: 0.20% or less;
Sn: 0.020% or less;
Sb: 0.025% or less;
B: 0.010% or less;
Cu: 0.50% or less;
Ni: 0.50% or less;
V: 0.20% or less;
Zr: 0.050% or less;
Nb: 0.100% or less; and
Mg: 0.0050% or less.

3. A method for manufacturing free-cutting steel, including:

rolling a rectangular cast steel into a billet at a heating temperature of 1120° C. or more and an area reduction rate of 60% or more, the cast steel having a cross section perpendicular to a longitudinal direction with a side length of 250 mm or more, the cast steel having a chemical composition containing (consisting of), in mass %, C: 0.08% or less,
Mn: 0.50% to 1.50%,
P: 0.100% or less,
S: 0.250% to 0.500%,
N: 0.0050% to 0.0150%,
O: more than 0.0100% and 0.0500% or less,
Cr: 0.50% to 1.50%, and at least one of Si, Al, or Ti: 0.050% to 0.500% in total, with the balance being Fe and inevitable impurities, with an A value defined by a following formula (1) satisfying 0.40 to 2.00, and with a B value defined by a following formula (2) satisfying $1.10\times10^{-3}$ to $1.50\times10^{-2}$; and hot-working the billet at a heating temperature of 1050° C. or more and an area reduction rate of 95% or more, wherein $$A\ \text{value}=[\text{Mn}]/[\text{Cr}] \quad (1)$$

$$B\ \text{value}=(2[\text{Si}]+2[\text{Al}]+[\text{Ti}])\times[\text{O}] \quad (2)$$

where [M] indicates a content in mass % of an element M described in [ ].

4. The method for manufacturing free-cutting steel according to the above 3, wherein the chemical composition further contains, in mass %, at least one selected from the group consisting of:

Ca: 0.0010% or less;
Se: 0.30% or less;
Te: 0.15% or less;
Bi: 0.20% or less;
Sn: 0.020% or less;
Sb: 0.025% or less;
B: 0.010% or less;
Cu: 0.50% or less;
Ni: 0.50% or less;
V: 0.20% or less;
Zr: 0.050% or less;
Nb: 0.100% or less; and
Mg: 0.0050% or less.

Advantageous Effect

It is possible to obtain free-cutting steel with excellent machinability, without adding lead.

DETAILED DESCRIPTION

Next, our free-cutting steel will be described in detail. First, reasons for limiting the content of each component in the chemical composition of the free-cutting steel will be described. Note that, the expression of % for the components means mass % unless otherwise specified.

C: 0.08% or Less

C is an important element that has a significant effect on the strength and machinability of steel. However, when a content exceeds 0.08%, carbide precipitates and hardens, so the machinability deteriorates. Therefore, the C content should be 0.08% or less. The C content is preferably within a range of 0.07% or less. From the viewpoint of ensuring the strength, the C content is preferably 0.01% or more. The C content is more preferably 0.03% or more.

Mn: 0.50% to 1.50%

Mn is a sulfide-forming element important for improving machinability. However, when a content is less than 0.50%, the amount of sulfide is small and sufficient machinability cannot be obtained, so a lower limit should be 0.50%. The content is preferably 0.60% or more. On the other hand, when the content exceeds 1.50%, the sulfide coarsens and elongates, thus resulting in reduction in the machinability. In addition, mechanical properties are reduced, so an upper limit of the Mn content should be 1.50%. The Mn content is preferably less than 1.40%.

P: 0.100% or Less

P is an element effective at reducing finished surface roughness by inhibiting generation of built-up edges during cutting work. From this viewpoint, it is preferable that P should be contained at 0.010% or more. However, when a content exceeds 0.100%, a material becomes harder and its hot workability and ductility significantly decrease. Therefore, the P content should be 0.100% or less. The P content is preferably 0.080% or less.

S: 0.250% to 0.500%

S is a sulfide-forming element effective to improvement in machinability. However, when an S content is less than 0.250%, the amount of sulfide is small, thus resulting in little effect of improving the machinability. On the other hand, when the S content exceeds 0.500%, the sulfide become too coarse and the number of fine sulfide particles is reduced, thus resulting in reduction in the machinability. In addition, hot workability and ductility, which is one of important mechanical properties, are reduced. Therefore, the S content should be within a range of 0.250% to 0.500%. The S content is preferably 0.300% or more. The S content is preferably 0.450% or less.

N: 0.0050% to 0.0150%

N forms nitrides with Cr and the like, and decomposition of the nitrides, due to increase in temperature during cutting work, forms a protective film on a tool surface. Since the film acts to protect the tool surface and increases tool life, N should be contained by 0.0050% or more. An N content is preferably 0.0060% or more. On the other hand, when more than 0.0150% of N is added, the effect of the Belag is saturated and the material becomes harder, thus resulting in shortening the tool life. Therefore, the N content should be 0.0050% to 0.0150%. The N content is preferably 0.0120% or less.

O: More than 0.0100% and 0.0500% or Less

In addition to forming oxide and serving as nuclei for precipitation of sulfide, O is an effective element for restraining elongation of the sulfide during hot-working such as rolling, and machinability can be improved by this action. Also, O is an important element that can contribute to generation of an oxide film called Belag on a tool surface. However, when a content is 0.0100% or less, the effect of restraining the elongation of the sulfide is not sufficient, and elongated sulfide remains and the original effect cannot be expected. Therefore, the O content should exceed 0.0100%. On the other hand, when more than 0.0500% of O is added, the effect of restraining the elongation of the sulfide is saturated and the amount of hard oxide inclusions increases, so the machinability deteriorates. Furthermore, since addition of an excessive amount of O has economically disadvantage, an upper limit should be 0.0500%.

Cr: 0.50% to 1.50%

Cr forms sulfide, and acts to improve machinability by lubricating action during cutting. Also, Cr restrains elongation of the sulfide during hot-working such as rolling, so the machinability can be improved. However, when a Cr content is less than 0.50%, generation of the sulfide is not sufficient and elongated sulfide tends to remain, so that the original sufficient effect cannot be sufficiently expected. On the other hand, when more than 1.50% of Cr is added, in addition to hardening, the sulfide becomes coarse and the effect of restraining the elongation of the sulfide is saturated, which even results in reduction in the machinability. Furthermore, addition of an excessive amount of the alloying element is economically disadvantageous. Therefore, the Cr content should be 0.50% to 1.50%. The Cr content is preferably 0.70% or more. The Cr content is preferably 1.30% or less.

At Least One of Si, Al, or Ti: 0.050% to 0.500% in Total

Si, Al, and Ti are deoxidizing elements and combine with oxygen during cutting to form an oxide film called Belag on a tool surface. The Belag reduces friction between a tool and a work material, thereby restraining tool wear. When the total addition of the respective elements is less than 0.050%, the amount of the generated Belag is low, so the elements should be added at a total of 0.050% or more. The total addition of the respective elements is preferably 0.070% or more. On the other hand, addition of more than 0.500% in total not only saturates the effect, but also increases the amount of oxide, thus causing abrasive wear to become more conspicuous and significantly reducing tool life. Therefore, an upper limit of the total addition of these elements should be 0.500%. The total addition is preferably 0.450% or less.

As well as the above components, the balance is Fe and inevitable impurities, and furthermore contains optional components as described below. Here, the chemical composition preferably consists of the above components, optionally any components described below, and the balance of iron and unavoidable impurities.

In the above chemical composition, it is essential that an A value defined by the following formula (1) should be 0.40 to 2.00.

$$A \text{ value}=[\text{Mn}]/[\text{Cr}] \quad (1)$$

where [M] indicates a content in mass % of an element M described in [ ].

Namely, the A value is an important index that determines the refinement of sulfide in a Mn—Cr—S system during hot-working such as rolling. By limiting the A value, it is possible to obtain fine sulfide and improve machinability. However, when the A value is less than 0.40, the amount of Cr is reduced in the sulfide and sulfide of Mn—S alone tends to be generated, so the sulfide tends to be coarse, thus resulting in deterioration in the machinability. On the other hand, when the A value exceeds 2.00, the number of fine sulfide particles themselves is reduced. Therefore, the A value should be 0.40 to 2.00. The A value is preferably 0.50 or more. The A value is preferably 1.80 or less.

Furthermore, in the above chemical composition, a B value defined by the following formula (2) is required to satisfy $1.10\times10^{-3}$ to $1.50\times10^{-2}$.

$$B \text{ value}=(2[\text{Si}]+2[\text{Al}]+[\text{Ti}])\times[\text{O}] \quad (2)$$

where [M] indicates a content in mass % of an element M described in [ ].

Namely, the B value is an important index that determines generation of an oxide film during cutting work. By keeping the B value within a specific range, the stable oxide film called Belag can be obtained and machinability can be improved. In other words, when the B value is less than $1.10\times10^{-3}$, it is difficult to form the oxide film, and the effect of improving the machinability becomes small. On the other hand, when the B value exceeds $1.50\times10^{-2}$, tool wear increases due to abrasive wear, because formation action of the oxide film is saturated and many hard oxides are crystallized in steel. Therefore, the B value should be $1.10\times10^{-3}$ to $1.50\times10^{-2}$. The B value is preferably $1.20\times10^{-3}$ or more. The B value is preferably $1.30\times10^{-2}$ or less.

Next, the optional components will be described. In addition to the above fundamental components, at least one of the following components can be contained as needed:

Ca: 0.0010% or less;
Se: 0.30% or less;
Te: 0.15% or less;
Bi: 0.20% or less;
Sn: 0.020% or less;
Sb: 0.025% or less;
B: 0.010% or less;
Cu: 0.50% or less;
Ni: 0.50% or less;
V: 0.20% or less;
Zr: 0.050% or less;
Nb: 0.100% or less; or
Mg: 0.0050% or less.

Ca, Se, Te, Bi, Sn, Sb, B, Cu, Ni, V, Zr, Nb, and Mg all act to improve machinability, and therefore the optional components may be added when importance is placed on the machinability. When these elements are contained to improve the machinability, a sufficient effect cannot be obtained with addition of less than 0.0001% of Ca, less than 0.02% of Se, less than 0.10% of Te, less than 0.02% of Bi, less than 0.003% of Sn, less than 0.003% of Sb, less than 0.003% of B, less than 0.05% of Cu, less than 0.05% of Ni, less than 0.005% of V, less than 0.005% of Zr, less than 0.005% of Nb, and less than 0.0005% of Mg. Therefore, respective contents should be preferably as follows: Ca: 0.0001% or more; Se: 0.02% or more; Te: 0.10% or more; Bi: 0.02% or more; Sn: 0.003% or more; Sb: 0.003% or more; B: 0.003% or more; Cu: 0.05% or more; Ni: 0.05% or more; V: 0.005% or more; Zr: 0.005% or more; Nb: 0.005% or more, and Mg: 0.0005% or more.

On the other hand, addition of more than 0.0010% of Ca, more than 0.30% of Se, more than 0.15% of Te, more than 0.20% of Bi, more than 0.020% of Sn, more than 0.025% of Sb, more than 0.010% of B, more than 0.50% of Cu, more than 0.50% of Ni, more than 0.20% of V, more than 0.050% of Zr, more than 0.100% of Nb, or more than 0.0050% of Mg causes saturation of this effect and economical disadvantage. Therefore, the content of each of these elements should be as follows: Ca: 0.0010% or less; Se: 0.30% or less; Te: 0.15% or less; Bi: 0.20% or less; Sn: 0.020% or less; Sb: 0.025% or less; B: 0.010% or less; Cu: 0.50% or less; Ni: 0.50% or less; V: 0.20% or less; Zr: 0.050% or less; Nb: 0.100% or less, and Mg: 0.0050% or less.

(Steel Microstructure)

Distribution of 3000 or More Sulfide Particles with an Equivalent Circular Diameter of 5 μm or Less Per $mm^2$ With respect to machinability, moderate fine dispersion of sulfide particles is advantageous for lubricating action between a tool and a work material during cutting work. To achieve this, a certain amount or more of sulfide particles with an equivalent circular diameter of 5 μm or less are required to be dispersed. The sulfide particles with the equivalent circular diameter of 5 μm or less are not only effective for lubrication between the tool and the work material but also for chip breakup, thus greatly improving the machinability. Therefore, the number of the sulfide particles with the equivalent circular diameter of 5 μm or less should be 3000 or more per $mm^2$.

The following describes conditions for manufacturing the free-cutting steel.

A rectangular cast steel of the above chemical composition, whose cross section perpendicular to a longitudinal direction has a side length of 250 mm or more, is rolled at a heating temperature of 1120° C. or more and an area reduction rate of 60% or more into a billet, and the billet is hot-worked at a heating temperature of 1050° C. or more and an area reduction rate of 95% or more.

(Cast Steel)

Rectangular Cross Section Perpendicular to Longitudinal Direction with Side Length of 250 mm or More First, molten steel the chemical composition of which is adjusted as described above is cast to make the cast steel. As the cast steel, a rectangular cast steel the cross section of which perpendicular to the longitudinal direction has a side length of 250 mm or more is used.

The cast steel is manufactured, as the cast steel with rectangular cross section, by continuous casting or ingot making. When the side length of the rectangular cross section is smaller than 250 mm, the size of sulfide particles increases during solidification of the cast steel. Therefore, coarse sulfide particles remain even after the cast steel is sequentially made into the billet by rolling of the cast steel, which is disadvantageous to final refinement of the sulfide particles after hot-working. Therefore, the side length of the cross section of the cast steel should be 250 mm or more. More preferably, the side length should be 300 mm or more. Although there is no need to specifically regulate an upper limit of the side length of the cross section of the cast steel, the above length should be preferably 600 mm or less from the viewpoint of feasibility of hot-rolling following casting.

(Hot-Rolling of Cast Steel into Billet)

Heating Temperature of Cast Steel: 1120° C. Or More

The cast steel is hot-rolled into the billet, and a heating temperature during the hot-rolling is required to be 1120° C. or more. When the heating temperature is less than 1120° C., coarse sulfide particles crystallized during cooling and solidification in a casting step are not dissolved, and the coarse sulfide particles remain after the billet is formed. As a result, even after subsequent hot-working, the sulfide particles remain coarse and desired distribution of fine sulfide particles cannot be obtained. Therefore, the heating temperature for hot-rolling the cast steel into the billet should be 1120° C. or more, and preferably 1150° C. or more. Although there is no need to specifically regulate an upper limit of the heating temperature of the cast steel, the heating temperature should be preferably 1300° C. or less, and more preferably 1250° C. or less, from the viewpoint of restraining scale loss.

Area Reduction Rate During Hot-Rolling of Cast Steel into Billet: 60% or More

Since the size of the sulfide particles crystallized during solidification is large, it is necessary to reduce the size to some extent during rolling of the cast steel. When the area reduction rate during hot-rolling is small, the billet is formed with the large sulfide particles. Therefore, it becomes difficult to refine the sulfide particles during heating and rolling when the billet is subsequently hot-worked into a steel bar or wire rod. Therefore, the cast steel should be hot-rolled into the billet at an area reduction rate of 60% or more.

The area reduction rate (%) during the hot-rolling can be calculated by the following formula, where S0 represents the cross-sectional area of the cross section of the cast steel, before the hot-rolling, perpendicular to a hot-rolling direction, and S1 represents the cross-sectional area of the cross section of the billet, manufactured by the hot-rolling, perpendicular to the hot-rolling direction.

$$100\times(S0-S1)/S0$$

(Hot-Working of Billet)

Heating Temperature: 1050° C. Or More

Heating temperature when the billet is hot-worked into the steel bar or wire rod is an important factor. When the heating temperature is less than 1050° C., the sulfide particles are not finely dispersed, which causes less lubrication action during cutting work. As a result, tool life is shortened due to increased tool wear. Therefore, the billet heating temperature should be 1050° C. or more. The billet heating temperature is more preferably 1080° C. or more. Although there is no need to specifically regulate an upper limit, the billet heating temperature is preferably 1250° C. or less from the viewpoint of restraining yield loss due to scale loss.

Area Reduction Rate During Hot-Working: 95% or More

The area reduction rate during the hot-working of the billet into the steel bar or wire rod is also an important factor for refinement of the sulfide particles. When the area reduction rate is less than 95%, the refinement of the sulfide particles is not sufficient, so a lower limit of the area reduction rate should be 95%. The area reduction rate during the hot-working can be calculated by the following formula, where S1 represents the cross-sectional area of the cross section of the billet, before the hot-rolling, perpendicular to a hot-working direction, and S2 represents the cross-sectional area of the cross section of the steel bar or wire rod, manufactured by the hot-working, perpendicular to the hot-working direction (stretching direction).

$$100\times(S1-S2)/S1$$

Regulating the above-described cast steel size and the heating temperature, as well as the billet size and the heating temperature, and the area reduction rates within the appropriate ranges allows refinement of the sulfide particles and improvement in the machinability.

Examples

Next, our free-cutting steel will be described in detail according to examples.

Steel of chemical compositions listed in Table 1 was cast in a continuous casting machine into rectangular cast steels whose cross sections perpendicular to a longitudinal direction have dimensions listed in Tables 2-1 and 2-2. The obtained cast steels were rolled into steel bars under manufacturing conditions listed in Tables 2-1 and 2-2. The steel of examples and comparative examples was subjected to the following tests. Namely, the cast steels were hot-rolled at a heating temperature and an area reduction rate listed in Tables 2-1 and 2-2 into rectangular billets with a long side dimension and a short side dimension listed in Tables 2-1 and 2-2. The obtained billets were heated at a heating temperature listed in Tables 2-1 and 2-2 and hot-rolled into steel bars with a diameter listed in Tables 2-1 and 2-2. The obtained steel bars (examples and comparative examples) were subjected to the following tests.

Specimens were taken from the cross sections of the obtained steel bars parallel to the rolling direction, and observation was made with a scanning electron microscope (SEM) at a position of ¼ from a periphery of the cross section in a radial direction to determine equivalent circular diameters and number density of sulfide particles in the steel. The chemical compositions of deposit were analyzed by energy dispersive X-ray spectrometry (EDX), and binarization was performed on the deposit that was identified to be sulfide particles by EDX by image analysis on obtained SEM images, to obtain the equivalent circular diameters and number density.

TABLE 1

(% by mass)

| No. | C | Si | Mn | P | S | Cr | Al | Ti | N | O | Others | Content of Si, Al and Ti* [Si] + [Al] + [Ti] | A value ** | B value *** | Category |
|---|---|---|---|---|---|---|---|---|---|---|---|---|---|---|---|
| 1 | 0.07 | 0.050 | 0.71 | 0.086 | 0.368 | 1.02 | 0.065 | 0.102 | 0.0096 | 0.0275 | — | 0.217 | 0.70 | $9.13 \times 10^{-3}$ | Example |
| 2 | 0.06 | 0.005 | 1.23 | 0.062 | 0.432 | 0.63 | 0.005 | 0.150 | 0.0125 | 0.0222 | — | 0.160 | 1.95 | $3.77 \times 10^{-3}$ | Example |
| 3 | 0.02 | 0.032 | 0.75 | 0.045 | 0.345 | 1.35 | 0.015 | 0.005 | 0.0088 | 0.0195 | — | 0.052 | 0.56 | $1.93 \times 10^{-3}$ | Example |
| 4 | 0.04 | 0.090 | 1.25 | 0.051 | 0.255 | 0.85 | 0.008 | 0.050 | 0.0105 | 0.0163 | — | 0.148 | 1.47 | $4.01 \times 10^{-3}$ | Example |
| 5 | 0.05 | 0.285 | 0.53 | 0.044 | 0.426 | 1.23 | 0.014 | 0.157 | 0.0075 | 0.0144 | — | 0.456 | 0.43 | $1.09 \times 10^{-2}$ | Example |
| 6 | 0.08 | 0.120 | 1.11 | 0.076 | 0.388 | 1.03 | 0.013 | 0.085 | 0.0111 | 0.0245 | Ca: 0.0010 | 0.218 | 1.08 | $8.60 \times 10^{-3}$ | Example |
| 7 | 0.05 | 0.108 | 0.68 | 0.066 | 0.315 | 1.45 | 0.005 | 0.010 | 0.0068 | 0.0265 | Se: 0.06, Te: 0.11 | 0.123 | 0.47 | $6.25 \times 10^{-3}$ | Example |
| 8 | 0.06 | 0.050 | 1.38 | 0.088 | 0.522 | 1.42 | 0.120 | 0.150 | 0.0099 | 0.0213 | Bi: 0.15, Sn: 0.012 | 0.320 | 0.97 | $1.04 \times 10^{-2}$ | Example |
| 9 | 0.04 | 0.485 | 0.92 | 0.081 | 0.543 | 1.15 | 0.006 | 0.005 | 0.0062 | 0.0148 | Sb: 0.015 | 0.496 | 0.80 | $1.46 \times 10^{-2}$ | Example |
| 10 | 0.07 | 0.123 | 1.15 | 0.065 | 0.368 | 1.15 | 0.002 | 0.003 | 0.0063 | 0.0316 | B: 0.0025 | 0.128 | 1.00 | $7.99 \times 10^{-3}$ | Example |
| 11 | 0.05 | 0.006 | 1.21 | 0.077 | 0.333 | 0.99 | 0.050 | 0.005 | 0.0099 | 0.0284 | Cu: 0.15, Ni: 0.15 | 0.061 | 1.22 | $3.32 \times 10^{-3}$ | Example |
| 12 | 0.07 | 0.029 | 1.46 | 0.075 | 0.366 | 0.82 | 0.324 | 0.050 | 0.0076 | 0.0198 | V: 0.052, Nb: 0.080 | 0.403 | 1.78 | $1.50 \times 10^{-2}$ | Example |
| 13 | 0.05 | 0.080 | 0.76 | 0.068 | 0.37 | 0.54 | 0.030 | 0.120 | 0.0089 | 0.0233 | Zr: 0.048 | 0.230 | 1.41 | $7.92 \times 10^{-3}$ | Example |
| 14 | 0.04 | 0.120 | 1.23 | 0.066 | 0.345 | 1.25 | 0.091 | 0.180 | 0.0123 | 0.0234 | Mg: 0.0022 | 0.391 | 0.98 | $1.41 \times 10^{-2}$ | Example |
| 15 | 0.09 | 0.010 | 0.85 | 0.055 | 0.403 | 0.95 | 0.003 | 0.050 | 0.0088 | 0.0198 | — | 0.063 | 0.89 | $1.50 \times 10^{-3}$ | Comparative example |
| 16 | 0.07 | 0.018 | 0.42 | 0.045 | 0.285 | 0.78 | 0.007 | 0.002 | 0.0067 | 0.0201 | — | 0.027 | 0.54 | $1.05 \times 10^{-3}$ | Comparative example |
| 17 | 0.05 | 0.010 | 1.55 | 0.06 | 0.301 | 0.82 | 0.003 | 0.050 | 0.0076 | 0.0156 | — | 0.063 | 1.89 | $1.19 \times 10^{-3}$ | Comparative example |
| 18 | 0.08 | 0.132 | 0.75 | 0.108 | 0.324 | 1.08 | 0.091 | 0.086 | 0.0080 | 0.0213 | — | 0.309 | 0.69 | $1.13 \times 10^{-2}$ | Comparative example |
| 19 | 0.04 | 0.015 | 0.69 | 0.065 | 0.240 | 0.79 | 0.005 | 0.065 | 0.0111 | 0.0198 | — | 0.085 | 0.87 | $2.08 \times 10^{-3}$ | Comparative example |
| 20 | 0.08 | 0.025 | 0.48 | 0.099 | 0.510 | 1.12 | 0.016 | 0.055 | 0.0098 | 0.0211 | — | 0.096 | 0.43 | $2.89 \times 10^{-3}$ | Comparative example |
| 21 | 0.06 | 0.001 | 0.84 | 0.012 | 0.321 | 0.46 | 0.034 | 0.029 | 0.0043 | 0.0199 | — | 0.064 | 1.83 | $1.97 \times 10^{-3}$ | Comparative example |
| 22 | 0.07 | 0.020 | 0.94 | 0.065 | 0.463 | 1.58 | 0.001 | 0.080 | 0.0123 | 0.0246 | — | 0.101 | 0.59 | $3.00 \times 10^{-3}$ | Comparative example |
| 23 | 0.05 | 0.010 | 0.78 | 0.008 | 0.399 | 0.99 | 0.003 | 0.100 | 0.0020 | 0.0132 | — | 0.113 | 0.79 | $1.66 \times 10^{-3}$ | Comparative example |
| 24 | 0.06 | 0.030 | 1.34 | 0.065 | 0.391 | 1.25 | 0.003 | 0.080 | 0.0160 | 0.0122 | — | 0.113 | 1.07 | $1.78 \times 10^{-3}$ | Comparative example |
| 25 | 0.05 | 0.020 | 0.63 | 0.023 | 0.406 | 0.95 | 0.001 | 0.084 | 0.0123 | 0.0095 | — | 0.105 | 0.66 | $1.20 \times 10^{-3}$ | Comparative example |
| 26 | 0.07 | 0.030 | 1.36 | 0.098 | 0.369 | 0.95 | 0.003 | 0.100 | 0.0076 | 0.0513 | — | 0.133 | 1.43 | $8.52 \times 10^{-3}$ | Comparative example |
| 27 | 0.07 | 0.017 | 0.77 | 0.067 | 0.357 | 1.23 | 0.013 | 0.014 | 0.0045 | 0.0233 | | 0.044 | 0.63 | $1.72 \times 10^{-3}$ | Comparative example |
| 28 | 0.05 | 0.324 | 1.15 | 0.016 | 0.435 | 0.88 | 0.112 | 0.080 | 0.0123 | 0.0152 | — | 0.516 | 1.31 | $1.45 \times 10^{-2}$ | Comparative example |
| 29 | 0.06 | 0.300 | 0.54 | 0.067 | 0.343 | 1.45 | 0.002 | 0.080 | 0.0116 | 0.0165 | — | 0.382 | 0.37 | $1.13 \times 10^{-2}$ | Comparative example |
| 30 | 0.07 | 0.025 | 1.36 | 0.054 | 0.324 | 0.55 | 0.002 | 0.080 | 0.0076 | 0.0231 | — | 0.107 | 2.47 | $3.10 \times 10^{-3}$ | Comparative example |
| 31 | 0.08 | 0.003 | 0.68 | 0.023 | 0.431 | 0.57 | 0.001 | 0.056 | 0.0098 | 0.0165 | — | 0.060 | 1.19 | $1.06 \times 10^{-3}$ | Comparative example |
| 32 | 0.08 | 0.142 | 1.25 | 0.089 | 0.312 | 1.08 | 0.067 | 0.123 | 0.0084 | 0.0289 | — | 0.332 | 1.16 | $1.56 \times 10^{-2}$ | Comparative example |

*Content of Si, Al, and Ti [Si] + [Al] + [Ti]: applicable range (0.050 to 0.500)

** A value = Mn/Cr ratio: applicable range (0.40 to 2.00)

*** B value = (2Si + 2Al + Ti) × O: applicable range ($1.10 \times 10^{-3}$ to $1.50 \times 10^{-2}$)

Machinability was evaluated by an external turning test. BNC-34C5 manufactured by Citizen Machinery Co., Ltd. was used as a cutting machine, and carbide EX35 bites TNGG160404R-N manufactured by Hitachi Tool Engineering, Ltd. and DTGNR2020 manufactured by Kyocera Corporation were used as a turning tip and a holder, respectively. A 15-fold diluted emulsion solution of Yushiroken FGE1010 manufactured by Yushiro Chemical Industry Co., Ltd. was used as a lubricant. Cutting conditions were as follows: a cutting speed of 150 m/min, a feed speed of 0.10 mm/rev, a cut depth of 2.0 mm, and a work length of 10 m.

The machinability was evaluated by tool's flank wear Vb after the above cutting test over a length of 10 m. The machinability was evaluated to be "good" when the flank wear Vb after the cutting test was 200 μm or less, and "poor" when the flank wear exceeds 200 μm.

Tables 2-1 and 2-2 indicate the test results for the steel of the examples and the comparative examples. As is apparent from Tables 2-1 and 2-2, the steel of the examples has good machinability compared to the steel of the comparative examples.

TABLE 2-1

| | | Rolling of cast steel (rolling cast steel into billet) | | | | Rolling of wire rod (rolling billet into steel bar) | | |
|---|---|---|---|---|---|---|---|---|
| No. | Steel No. | Long side of cross-sectional dimensions of cast steel (mm) | Short side of cross-sectional dimensions of cast steel (mm) | Heating temperature (° C.) | Area reduction rate during rolling of cast steel (%) | Long side of cross-sectional dimensions of billet (mm) | Short side of cross-sectional dimensions of billet (mm) | Heating temperature (° C.) |
| 1 | 1 | 350 | 350 | 1170 | 78 | 165 | 165 | 1100 |
| 2 | 2 | 350 | 350 | 1170 | 78 | 165 | 165 | 1100 |
| 3 | 3 | 350 | 350 | 1170 | 78 | 165 | 165 | 1100 |
| 4 | 4 | 350 | 350 | 1170 | 78 | 165 | 165 | 1100 |
| 5 | 5 | 350 | 350 | 1170 | 78 | 165 | 165 | 1100 |
| 6 | 6 | 350 | 350 | 1170 | 78 | 165 | 165 | 1100 |
| 7 | 7 | 350 | 350 | 1170 | 78 | 165 | 165 | 1100 |
| 8 | 8 | 350 | 350 | 1170 | 78 | 165 | 165 | 1100 |
| 9 | 9 | 350 | 350 | 1170 | 78 | 165 | 165 | 1100 |
| 10 | 10 | 350 | 350 | 1170 | 78 | 165 | 165 | 1100 |
| 11 | 11 | 350 | 350 | 1170 | 78 | 165 | 165 | 1100 |
| 12 | 12 | 350 | 350 | 1170 | 78 | 165 | 165 | 1100 |
| 13 | 13 | 350 | 350 | 1170 | 78 | 165 | 165 | 1100 |
| 14 | 14 | 350 | 350 | 1170 | 78 | 165 | 165 | 1100 |
| 15 | 1 | 400 | 400 | 1170 | 83 | 165 | 165 | 1100 |
| 16 | 1 | 350 | 350 | 1250 | 78 | 165 | 165 | 1100 |
| 17 | 1 | 350 | 350 | 1170 | 84 | 140 | 140 | 1100 |
| 18 | 1 | 350 | 350 | 1170 | 78 | 165 | 165 | 1140 |
| 19 | 1 | 350 | 350 | 1170 | 78 | 165 | 165 | 1100 |
| 20 | 1 | 250 | 250 | 1120 | 60 | 158 | 158 | 1050 |

| | Rolling of wire rod (rolling billet into steel bar) | | Properties of steel bar (distribution of inclusions, test result of machinability) | | |
|---|---|---|---|---|---|
| No. | Diameter of steel bar (mm) | Area reduction rate during rolling of wire rod (%) | Number density of sulfide grains with equivalent circular diameter of 5 μm or less (number/mm$^2$) | Tool life (machinability) | Category |
| 1 | 20 | 99 | 3369 | Good | Example |
| 2 | 20 | 99 | 3581 | Good | Example |
| 3 | 20 | 99 | 3962 | Good | Example |
| 4 | 20 | 99 | 3695 | Good | Example |
| 5 | 20 | 99 | 4240 | Good | Example |
| 6 | 20 | 99 | 4095 | Good | Example |
| 7 | 20 | 99 | 3754 | Good | Example |
| 8 | 20 | 99 | 7333 | Good | Example |
| 9 | 20 | 99 | 5821 | Good | Example |
| 10 | 20 | 99 | 4227 | Good | Example |
| 11 | 20 | 99 | 3536 | Good | Example |
| 12 | 20 | 99 | 3777 | Good | Example |
| 13 | 20 | 99 | 3438 | Good | Example |
| 14 | 20 | 99 | 4284 | Good | Example |
| 15 | 20 | 99 | 5546 | Good | Example |
| 16 | 20 | 99 | 6247 | Good | Example |
| 17 | 20 | 98 | 5147 | Good | Example |
| 18 | 20 | 99 | 4563 | Good | Example |

TABLE 2-1-continued

| | | | | | |
|---|---|---|---|---|---|
| 19 | 14 | 99 | 3895 | Good | Example |
| 20 | 38 | 95 | 3211 | Good | Example |

*1 Underlines indicate out of range.

*2 Number density of sulfide particles with equivalent circle diameter of 5 μm or less: applicable range (3000 or more number/mm$^2$)

*3 Tool life (machinability) Good: tool wear of 200 μm or less; Poor: tool wear of more than 200 μm

TABLE 2-2

| | | Rolling of cast steel (rolling cast steel into billet) | | | | Rolling of wire rod (rolling billet into steel bar) | | |
|---|---|---|---|---|---|---|---|---|
| No. | Steel No. | Long side of cross-sectional dimensions of cast steel (mm) | Short side of cross-sectional dimensions of cast steel (mm) | Heating temperature (° C.) | Area reduction rate during rolling of cast steel (%) | Long side of cross-sectional dimensions of billet (mm) | Short side of cross-sectional dimensions of billet (mm) | Heating temperature (° C.) |
| 21 | 1 | 245 | 245 | 1170 | 60 | 155 | 155 | 1100 |
| 22 | 1 | 350 | 350 | 1080 | 78 | 165 | 165 | 1100 |
| 23 | 1 | 250 | 250 | 1170 | 56 | 165 | 165 | 1100 |
| 24 | 1 | 350 | 350 | 1170 | 78 | 165 | 165 | 1025 |
| 25 | 1 | 350 | 350 | 1170 | 78 | 165 | 165 | 1100 |
| 26 | 15 | 350 | 350 | 1180 | 79 | 160 | 160 | 1100 |
| 27 | 16 | 350 | 350 | 1180 | 79 | 160 | 160 | 1100 |
| 28 | 17 | 350 | 350 | 1180 | 79 | 160 | 160 | 1100 |
| 29 | 18 | 350 | 350 | 1180 | 79 | 160 | 160 | 1100 |
| 30 | 19 | 350 | 350 | 1180 | 79 | 160 | 160 | 1100 |
| 31 | 20 | 350 | 350 | 1180 | 79 | 160 | 160 | 1100 |
| 32 | 21 | 350 | 350 | 1180 | 79 | 160 | 160 | 1100 |
| 33 | 22 | 350 | 350 | 1180 | 79 | 160 | 160 | 1100 |
| 34 | 23 | 350 | 350 | 1180 | 79 | 160 | 160 | 1100 |
| 35 | 24 | 350 | 350 | 1180 | 79 | 160 | 160 | 1100 |
| 36 | 25 | 350 | 350 | 1180 | 79 | 160 | 160 | 1100 |
| 37 | 26 | 350 | 350 | 1180 | 79 | 160 | 160 | 1100 |
| 38 | 27 | 350 | 350 | 1180 | 79 | 160 | 160 | 1100 |
| 39 | 28 | 350 | 350 | 1180 | 79 | 160 | 160 | 1100 |
| 40 | 29 | 350 | 350 | 1180 | 79 | 160 | 160 | 1100 |
| 41 | 30 | 350 | 350 | 1180 | 79 | 160 | 160 | 1100 |
| 42 | 31 | 350 | 350 | 1180 | 79 | 160 | 160 | 1100 |
| 43 | 32 | 350 | 350 | 1180 | 79 | 160 | 160 | 1100 |

| | Rolling of wire rod (rolling billet into steel bar) | | Properties of steel bar (distribution of inclusions, test result of machinability) | | |
|---|---|---|---|---|---|
| No. | Diameter of steel bar (mm) | Area reduction rate during rolling of wire rod (%) | Number density of sulfide particles with equivalent circular diameter of 5 μm or less (nunber/mm$^2$) | Tool life (machinability) | Category |
| 21 | 20 | 99 | 2768 | Poor | Comparative example |
| 22 | 20 | 99 | 2214 | Poor | Comparative example |
| 23 | 20 | 99 | 2369 | Poor | Comparative example |
| 24 | 20 | 99 | 1496 | Poor | Comparative example |
| 25 | 50 | 93 | 1965 | Poor | Comparative example |
| 26 | 20 | 99 | 3689 | Poor | Comparative example |
| 27 | 20 | 99 | 2465 | Poor | Comparative example |
| 28 | 20 | 99 | 2146 | Poor | Comparative example |
| 29 | 20 | 99 | 3139 | Poor | Comparative example |
| 30 | 20 | 99 | 1814 | Poor | Comparative example |

TABLE 2-2-continued

| | | | | | |
|---|---|---|---|---|---|
| 31 | 20 | 99 | 2618 | Poor | Comparative example |
| 32 | 20 | 99 | 1881 | Poor | Comparative example |
| 33 | 20 | 99 | 4687 | Poor | Comparative example |
| 34 | 20 | 99 | 3666 | Poor | Comparative example |
| 35 | 20 | 99 | 4998 | Poor | Comparative example |
| 36 | 20 | 99 | 3420 | Poor | Comparative example |
| 37 | 20 | 99 | 4005 | Poor | Comparative example |
| 38 | 20 | 99 | 3839 | Poor | Comparative example |
| 39 | 20 | 99 | 4214 | Poor | Comparative example |
| 40 | 20 | 99 | 2597 | Poor | Comparative example |
| 41 | 20 | 99 | 1916 | Poor | Comparative example |
| 42 | 20 | 99 | 3123 | Poor | Comparative example |
| 43 | 20 | 99 | 3542 | Poor | Comparative example |

*1 Underlines indicate out of range.

*2 Number density of sulfide particles with equivalent circle diameter of 5 μm or less: applicable range (3000 or more number/mm$^2$)

*3 Tool life (machinability) Good: tool wear of 200 μm or less; Poor: tool wear of more than 200 μm

The invention claimed is:

1. Free-cutting steel comprising:

a chemical composition containing, in mass %,

C: 0.08% or less,

Mn: 0.50 to 1.50%,

P: 0.100% or less,

S: 0.250 to 0.500%,

N: 0.0050 to 0.0150%,

O: more than 0.0100% and 0.0500% or less,

Cr: 0.70 to 1.50%, and a total amount of at least one element selected from a group consisting of Si, Al, and Ti of 0.050 to 0.500%, wherein a content of Ti is 0.010% or less, with the balance being Fe and inevitable impurities, with an A value defined by a following formula (1) satisfying 0.40 to 2.00, and with a B value defined by a following formula (2) satisfying $1.10\times10^{-3}$ to $1.50\times10^{-2}$; and a steel microstructure with distributed 3000 or more sulfide particles with an equivalent circular diameter of 5 μm or less per mm$^2$, wherein $$A \text{ value}=[\text{Mn}]/[\text{Cr}] \quad (1)$$

$$B \text{ value}=(2[\text{Si}]+2+[\text{Ti}])\times[\text{O}] \quad (2)$$

where [M] indicates a content in mass % of an element M described in [ ].

2. The free-cutting steel according to claim 1, wherein the chemical composition further contains, in mass %, at least one selected from the group consisting of:

Ca: 0.0010% or less;

Se: 0.30% or less;

Te: 0.15% or less;

Bi: 0.20% or less;

Sn: 0.020% or less;

Sb: 0.025% or less;

B: 0.010% or less;

Cu: 0.50% or less;

Ni: 0.50% or less;

V: 0.20% or less;

Zr: 0.050% or less;

Nb: 0.100% or less; and

Mg: 0.0050% or less.

3. The free-cutting steel according to claim 1, wherein the sulfide is in a Mn—Cr—S system.

4. A method for manufacturing the free-cutting steel according to claim 1, comprising:

rolling a rectangular cast steel into a billet at a heating temperature of 1120° C. or more and an area reduction rate of 60% or more, the cast steel having a cross section perpendicular to a longitudinal direction with a side length of 250 mm or more, the cast steel having a chemical composition containing, in mass %, C: 0.08% or less, Mn: 0.50% to 1.50%, P: 0.100% or less, S: 0.250% to 0.500%, N: 0.0050% to 0.0150%, O: more than 0.0100% and 0.0500% or less, Cr: 0.70% to 1.50%, and a total amount of at least one element selected from a group consisting of Si, Al, and Ti of 0.050 to 0.500%, wherein a content of Ti is 0.010% or less, with the balance being Fe and inevitable impurities, with an A value defined by a following formula (1) satisfying 0.40 to 2.00, and with a B value defined by a following formula (2) satisfying $1.10\times10^{-3}$ to $1.50\times10^{-2}$; and hot-working the billet at a heating temperature of 1050° C. or more and an area reduction rate of 95% or more, wherein $$A \text{ value}=[\text{Mn}]/[\text{Cr}] \quad (1)$$

$$B \text{ value}=(2[\text{Si}]+2[\text{Al}]+[\text{Ti}])\times[\text{O}] \quad (2)$$

where [M] indicates a content in mass % of an element M described in [ ].

5. The method for manufacturing free-cutting steel according to claim 4, wherein the chemical composition further contains, in mass %, at least one selected from the group consisting of:

Ca: 0.0010% or less;
Se: 0.30% or less;
Te: 0.15% or less;
Bi: 0.20% or less;
Sn: 0.020% or less;
Sb: 0.025% or less;
B: 0.010% or less;
Cu: 0.50% or less;
Ni: 0.50% or less;
V: 0.20% or less;
Zr: 0.050% or less;
Nb: 0.100% or less; and
Mg: 0.0050% or less.

* * * * *